United States Patent [19]

Winkley et al.

[11] 3,957,026

[45] May 18, 1976

[54] COLD STARTING ENRICHMENT DEVICE

[76] Inventors: Jerry H. Winkley, 2005 Northaire Lane, St. Louis, Mo. 63138; Ralph G. Hardwick, 4265 Shenandoah, St. Louis, Mo. 63110

[22] Filed: July 24, 1974

[21] Appl. No.: 491,194

[52] U.S. Cl. ..... 123/179 G; 261/39 D; 261/39 B

[51] Int. Cl.[2] ..... F02N 17/00

[58] Field of Search ..... 261/39 D, 39 B; 123/179 G, 119 F, 124 A

[56] References Cited

UNITED STATES PATENTS

| | | | |
|---|---|---|---|
| 2,074,471 | 3/1937 | Holley et al. | 261/39 D |
| 2,264,996 | 12/1942 | Messinger | 261/39 D |
| 2,675,792 | 4/1954 | Brown et al. | 261/39 D |
| 3,249,345 | 5/1966 | Gast | 261/39 D |
| 3,278,171 | 10/1966 | Carlson | 261/39 D |
| 3,642,256 | 2/1972 | Phelps | 261/39 D |
| 3,706,444 | 12/1972 | Masaki et al. | 261/39 D |

*Primary Examiner*—Charles J. Myhre
*Assistant Examiner*—James D. Liles

[57] ABSTRACT

A carburetor for an internal combustion engine is provided with auxiliary fuel means for continuously regulating the fuel air ratio from a first, cold start condition to a second, normal run condition. The auxiliary fuel means includes a vacuum operated metering system to provide the additional fuel required for starting and running the engine untile the engine reaches normal operating temperature, and a combination shut-off valve and air bleed. In the preferred embodiment, the air bleed is actuated by manifold pressure overcoming the closing force of a thermostatic coil, and is open whenever the engine starts. The air bleed increases air input to the auxiliary fuel supply, thereby reducing fuel richness after start. A temperature sensitive element such as a bimetal coil is utilized to operate the shut-off valve and completely closes the auxiliary fuel means input to the engine at some predetermined temperature.

5 Claims, 5 Drawing Figures

COLD STARTING ENRICHMENT DEVICE

BACKGROUND OF THE INVENTION

This invention relates to carburetors for internal combustion engines and in particular to means for producing fuel enrichment to an internal combustion engine during cold start and warm-up periods.

Increasingly stringent motor vehicle exhaust emission regulations, coupled with performance and economy requirements impose increasingly new demands on todays internal combustion components, particularly carburetors.

Difficult problems are encountered during engine warm-up with conventional carburetor systems. Most present day internal combustion engines utilize a carburetor choke system having a choke value pivotally mounted in the air passageway of the carburetor. The choke system is mechanically coupled to a thermostatic coil which, when cold, pushes the choke valve closed. A cold engine is difficult to start. Only the most highly volatile parts of the fuel vaporize, so it becomes necessary to provide extra fuel to the engine manifold in order to insure that each of the individual cylinders receive sufficient fuel for combustion. Conversion of fuel from liquid to a vapor may take place within the combustion chambers of the engine cylinders. When the engine is cranked with the choke valve closed, the choke becomes the air restriction and the entire bore of the carburetor is subject to manifold pressure. Fuel will enter the carburetor from all available passages leading from the bore to the carburetor fuel bowl. Just as soon as the engine starts, the choke valve is partially opened to prevent the manifold from becoming flooded with fuel. A cold engine also requires a richer mixture during the warm-up period, and throughout this period the choke valve is used to restrict the incoming air just enough to produce the extra richness. When the engine reaches normal operating temperature, the choke should be wide open.

It heretofore has been conventional to couple the choke valve to some form of choke break, for example, to a vacuum piston and cylinder, to regulate choke system operation during the warm-up period. In the vacuum piston and cylinder arrangement, manifold pressure is applied to a small piston which rides in a cylinder having two slots or scores which extend longitudinally along the cylinder wall. Full manifold pressure is exerted on the piston until the piston moves into the area having the slots formed therein, after which air is permitted to leak past the piston. Consequently, the choke valve will open under the influence of the piston after the engine starts. The initial opening of the choke valve after start is controlled by the distance the scores extend up the cylinder wall. Air which passes around the piston comes from within the thermostatic coil housing. As indicated, the thermostatic coil also is coupled to the choke valve. The housing is connected to a heat pocket in the exhaust manifold. In this way, the thermostatic coil position becomes a direct indicator of engine temperature. As the engine warms up, the thermostatic coil tension is lessened, and the choke valve is opened accordingly. During acceleration in the warm-up period, opening the throttle raises the manifold pressure, i.e., decreases manifold vacuum. The vacuum piston becomes less effective at holding the choke open. The thermostatic coil tries to pull the choke valve towards the closed position. The difference in pressure above and below the choke valve forces the choke valve open to the proper position for enriched accelerating mixture.

While conventional choke systems work well for their intended purposs, they are not subject to precision regulation. The amount of fuel delivered to the engine is proportional to the flow of air. These proportions are determined by the relative sizes of the air and fuel restrictions. Conventional choke systems vary the air restrictions during start and engine warm-up to provide the necessary air-fuel ratios. With the advent of vehicle exhaust emission regulations, fuel-air mixture enrichment sufficient to operate the engine in cold start situations is difficult to achieve with the conventional choke circuit described above.

The prior art reveals various solutions to the fuel enrichment problem in the present day emission control environment. One such problem is shown and described in the U.S. Pat. No. 3,739,760, to Charron, issued July 19, 1973. While the Charron patent works for its intended purposes, the invention described hereinafter, besides being structurally distinct from the Charron disclosure is an advancement over it in that precise metering of the fuel input to the auxiliary fuel enrichment system may be obtained while the remaining parts of a conventional carburetor structure are retained, including fast idle feature found in present carburetor systems. Because relatively little modification to present carburetor structures is required, the auxiliary fuel system disclosed hereinafter may be applied to a wide range of carburetor models presently utilized with internal combustion engines. The system is designed so that although full manifold vacuum is applied to the auxiliary fuel outlet port, a relatively constant vacuum signal to the metering points of the auxiliary fuel system is maintained by a variable air bleed. Consequently, fuel restriction size is the only other variable in the system and it is controlled by a metering device.

One of the objects of this invention is to provide an auxiliary fuel enrichment system which replaces the conventional choke system in a carburetor structure for an internal combustion engine.

Another object of this invention is to provide an auxiliary fuel system for an internal combustion engine which may be continually monitored and controlled precisely.

Another object of this invention is to provide an auxiliary fuel system compatible with a wide range of carburetor types.

Another object of this invention is to provide an auxiliary fuel system having its fuel input located downstream from or, during certain running conditions, in ported relationship to the throttle plate of a carburetor structure.

Another object of this invention is to provide an auxiliary fuel system having a metered fuel output.

Other objects of this invention will become apparent to those skilled in the art in light of the following description and accompany drawings.

SUMMARY OF THE INVENTION

In accordance with this invention, generally stated, an auxiliary fuel system for enriching the fuel-air mixture of an internal combustion engine during cold starts of the engine is disclosed. The system includes an auxiliary fuel passage having an outlet opening placed downstream of or, during certain running conditions, in ported relationship to the throttle valve in the main air bore opening of a carburetor structure. The system includes means for stopping fuel output through the auxiliary fuel system, means for injecting air into the auxiliary fuel system after engine start, means for metering fuel input to the auxiliary fuel system, and means for providing an enriched fuel mixture to the engine for acceleration during the warm-up period.

DESCRIPTION OF THE PREFERRED EMBODIMENT

Figure 1:
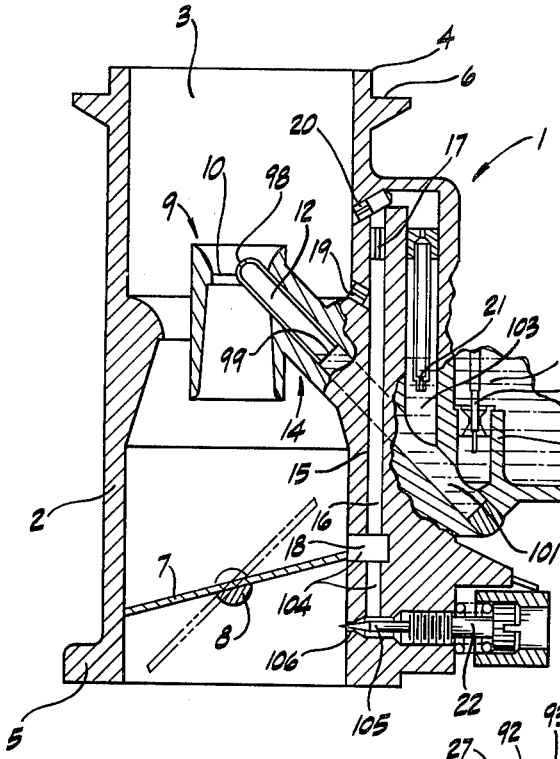
FIG. 1 is a sectional view, partly broken away, of a carburetor structure showing the main venturi and idle circuit for the carburetor.

Referring now to FIG. 1, reference numeral 1 indicates a carburetor structure incorporating the usual main and idle fuel systems.

The carburetor structure 1 includes a housing 2 having a main air bore passageway 3 extending through it. Conventionally, the air passageway 3 has a first end 4 and a second end 5. The first end 4 may be provided with an annular flange 6 for mounting an air cleaner, not shown, to the carburetor structure 1. The end 5 commonly is fitted to an engine manifold, not shown, which distributes the fuel-air mixture from the carburetor to the cylinders of an internal combustion engine, also not shown. A throttle valve 7 is movably mounted to the housing 2 near the end 5 of the passageway 3 and is operatively connected, via a shaft 8 to a throttle control pedal, generally placed in the passenger compartment, for example, of vehicles in which the carburetor structure 1 finds utility.

A venturi restriction 9 commonly is placed in the main air passageway 3 for providing a streamline restriction producing a smooth flow of air and a greater pressure drop in a throat 10 of the venturi restriction 9.

The housing 2 includes a fuel bowl structure 11 having a predetermined level of fuel 99 maintained in it. Fuel level 99 is controlled by a carburetor float circuit, not shown, which controls fuel input to the bowl 11.

The housing 2 has a main fuel passage 12 formed in it. The passage 12 has an end 98 opening in the air passageway 3 near the throat 10 of the venturi restriction 9, and an end 101 opening in the fuel bowl 11. This arrangement is known both in the art, and for the purposes of this specification, as a high speed circuit 14. With no air flowing through the main air passageway 3, the fuel in the main fuel passage 12 will be at the same level as the fuel level 99 in the bowl 11. The float of the carburetor float circuit is set to keep the liquid level slightly lower than the open end 98 of the passage 12. Since the rate of flow of fuel is proportional to the pressure difference across the venturi restriction 9 and the proportion can be adjusted by changing the relative size of the air and the fuel restrictions, it is conventional to adjust the fuel outlet from the fuel bowl 11 to the main fuel passage 12 along the end 101 of the passage 12 by means of the metering device 13. The device 13 is conventional and is not described in detail. Commonly, device 13 is vacuum controlled, vacuum being sensed at the engine inlet manifold, for example and/or mechanically controlled by a link to the throttle. In general, various portions of the metering device 13 are inserted in a restriction 102 to vary the amount of fuel entering the end 101 of the passage 12, so as to correspond to light, part and full throttle operation of the engine.

As the rate of air flow through the carburetor 1 structure is reduced by closing the throttle 7, a point is reached where the venturi restriction 9 no longer restricts the air. This point may vary depending on the size and number of venturi restrictions, the size of the engine and other well known considerations not enumerated here. Consequently, fuel for idle and low speeds must be obtained from some other source. A low speed circuit 15 provides the fuel mixture whenever the engine requires a change-over from the high speed circuit 14 above described to the low speed circuit or idle circuit 15.

The low speed circuit 15 includes a passage 16 formed in the housing 2 which bypasses fuel around the almost closed throttle valve 7 when the throttle valve 7 is in the idle position, the position shown by full lines in FIG. 1. An end 103 of the passage 16 is connected to the fuel bowl 11 through a restriction 17. A second end 104 of the passage 16 opens to an idle port 18 located in the main air passageway 3 at a point where it will be partially covered by the throttle valve 7 in the idle position of the valve 7. Idle port 18 conventionally is so located because fuel for idle must be well mixed with air so that the mixture can be delivered equally to all of the engine cylinders. This is accomplished by discharging the fuel into the fast moving air passing around the throttle valve 7. As the throttle valve 7 is slowly opened from idle position, more fuel must be delivered through the idle circuit 15. Manifold vacuum usually begins to drop as soon as the throttle valve 7 starts to open. This will decrease the pressure difference between the ends 104 and 103 of the low speed circuit 15 resulting in less fuel flow. However, fast moving air passing over the idle port 18 induces what is known in the art as "dynamic pressure." The faster the air passes over the idle port 18, the lower the pressure in the port 18. Consequently, the pressure difference between the two ends of the passage 16 is increased as the throttle valve is slowly opened, as atmospheric pressure in the fuel remains constant throughout idle operation.

An idle bleed 19 is formed in the housing 2 and extends between the passage 16 and the main air passage 2. Air entering through idle bleed 19 into the passage 16 from the passageway 3 raises pressure in the passage 16 and tends to lean the fuel-air mixture.

The restriction 17, generally known in the art as an economizer, restricts and mixes fuel and air flowing through the passage 16. Air for mixing in the restriction 17 enters the passage 16 through a bypass opening 20 formed in the housing 2 between the main air passageway 3 and the passage 16. Since air enters the passage 16 through the bypass opening 20, some atomization occurs in the passage 16 prior to the entrance of the fuel-air mixture into the restriction 17. Means 21 for metering the fuel entering the low speed circuit 15 commonly is provided in the passage 16 at the fuel bowl 11 end 103.

Idle adjustment means 22 conventionally is provided to control the pressure at the idle port 18, and consequently the pressure difference applied to the low speed circuit 15. Idle adjustment means 22 includes a needle valve 105 adjustably mounted in an opening 106 formed in the housing 2 between the air passageway 3 and the end 104 of the passage 16. By adjusting the position of the valve 105 in the opening 106, the pressure difference between the ends 104 and 103 of the passage 16 may be varied.

To recapitulate, fuel for the low speed circuit 15 is metered through the means 21. Air entering the passage 16 through the bypass 20 begins to atomize the fuel. The restriction or economizer 17 speeds up the flow of the fuel and air mixture, which also thoroughly mixes the fuel and the air. Air entering the passage 16 through the idle bleed 19 further leans the fuel and air mixture and speeds its delivery to the idle port 18. The mixture of fuel and air from the idle port 18 mixes with the air rushing around the throttle valve 7. By bleeding air into the passage 16 at the idle bleed 19 and restricting the air-fuel mixture with the restriction 17, the low pressure present at the idle port 18 has been raised almost to atmospheric pressure at the metering means 21. The relatively low pressure difference between the metering means 21 and atmospheric pressure present in the fuel bowl 11 requires a fuel metering opening many times larger than would be required if idle port 18 pressure had been applied directly to the metering means 21.

Figure 5:
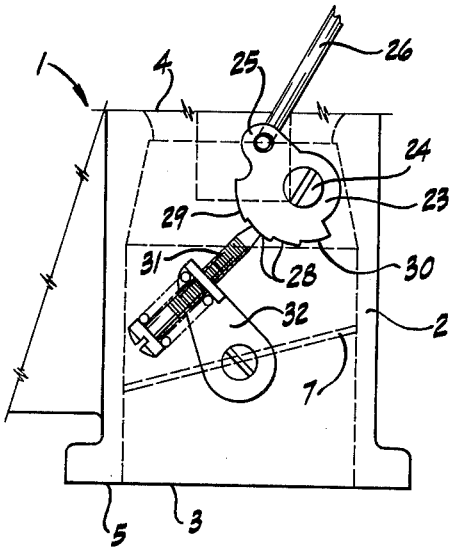
FIG. 5 is a view in side elevation of the carburetor structure of FIG. 1 illustrating a fast idle circuit compatible with the auxiliary fuel system of this invention.

During the engine warm-up period following a cold start, engine speed must be increased to prevent stalling. Conventionally, this has been accomplished by a fast idle cam 23 which blocks the throttle valve 7 open, best illustrated in FIG. 5. The fast idle cam 23 is compatible with the carburetor 1 and the relationship of the cam 23 with an auxiliary fuel supply system 100 of this invention can best be understood by reference to FIGS. 2 and 5. As there shown, the cam 23 is pivotally mounted to the housing 2 along a pivot axis 24. The cam 23 includes a connection arm 25 having an end of a connecting rod 26 attached to it. The second end of the rod 26 is attached to a plate 27, the function, construction and operation of which is later described in detail. The fast idle cam 23 has a plurality of steps 28 formed in it, which range from a starting step 29 to a bottom step 30.

A throttle valve set screw 31 is operatively connected to the shaft 8 of the throttle valve 7 along a linkage 32. Constructional features of the linkage 32, set screw 31 and cam 23 are well known in the art and are not described in detail. It is here sufficient to state that the depression of the throttle control of the internal combustion engine, for example, rotates the throttle valve 7 counter clockwise, as referenced to FIG. 5, disengaging the set screw 31 from against whichever of the steps 28 it may be resting. A thermostatic coil 33 (FIG. 2) is operatively connected to a rod 34. Rod 34 in turn is rotatably mounted with respect to the carburetor structure 1. Rod 34 has a first end attached to the plate 27 and a second end attached to a link arm 107. The plate 27 also is rotatably mounted with respect to the carburetor structure 1. When the engine in which carburetor 1 is utilized is cold, the thermostatic coil 33 will contract, rotating the rod 34 counter clockwise as referenced to FIG. 2. Rotation of the rod 34 rotates the plate 27 counter clockwise, which will tend to move the rod 26 downwardly. When the adjusting screw 31 is lifted as by depression of the throttle pedal, the rod 26 will move the cam 23 to the starting step 29. Upon release of the throttle pedal, the throttle valve 7 will tend to close. However, the set screw 31 will engage the cam 23 along the starting step 29 which engagement will prop the valve 7 open to insure the correct throttle valve 7 position for the best possible distribution of fuel to the cylinders during the warm-up period following ignition.

As the engine warms, the thermostatic coil 33 expands, which, through the interaction of the rod 34 and plate 27, will move the connecting rod 26 upwardly, permitting the set screw 31 to engage successive ones of the steps 28 and to correctly position the throttle valve 7 in accordance with the increased engine temperature. When the engine is hot, the step 30 on the cam 23 falls clear of the set screw 31 with the curb stop (not shown), correctly positioning the throttle valve 7 for hot idle engine speed.

While both the main fuel passage 12 and the idle passage 16 are available as fuel sources for starting a cold engine, the requirements for a cold start are such that only an exceedingly rich mixture will ignite and provide the power necessary to overcome the inertia of the remaining internal combustion engine parts. Conventionally, this enriched mixture was provided by operation of the choke circuit. Our invention differs from prior art devices in that the choke valve is eliminated and the auxiliary fuel system 100, which can more accurately control the fuel mixture during the warm-up period after start-up, is substituted for it.

Figure 2:
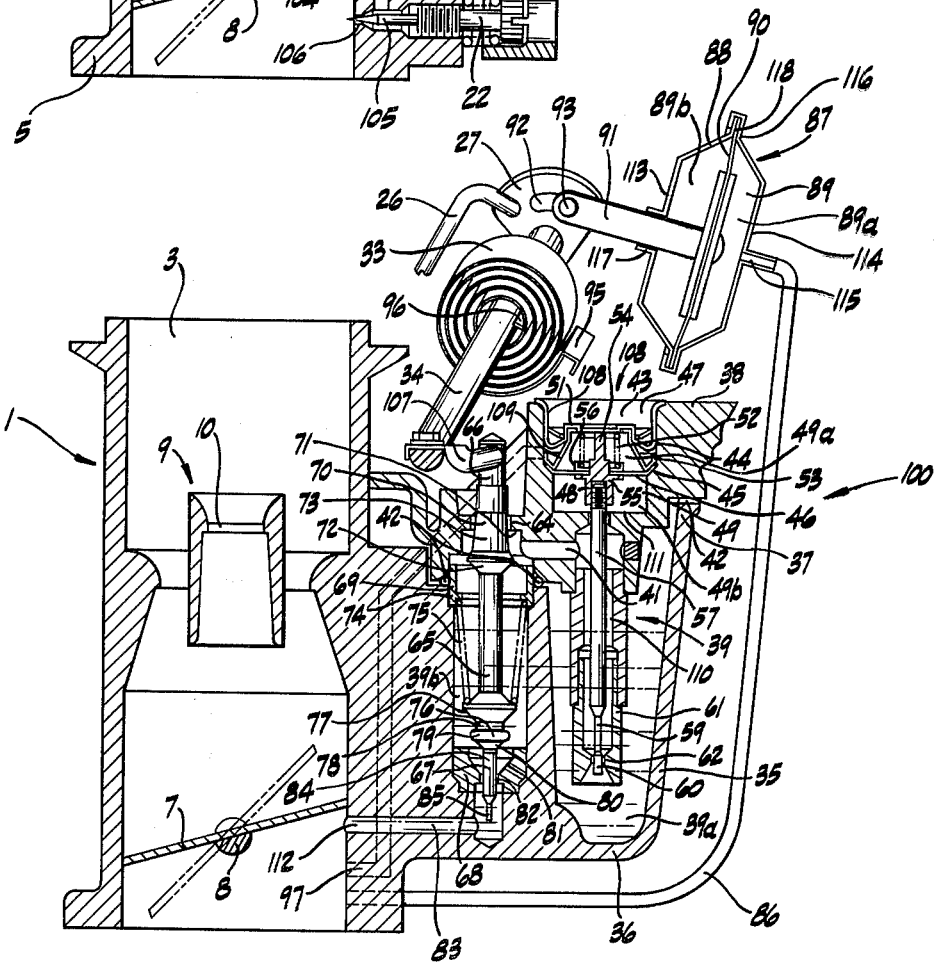
FIG. 2 is a sectional view, partly broken away, of the carburetor structure of FIG. 1 adapted to utilize the auxiliary fuel system of this invention, the auxiliary fuel system being shown in the warm-up position of engine operation.
Figure 3:
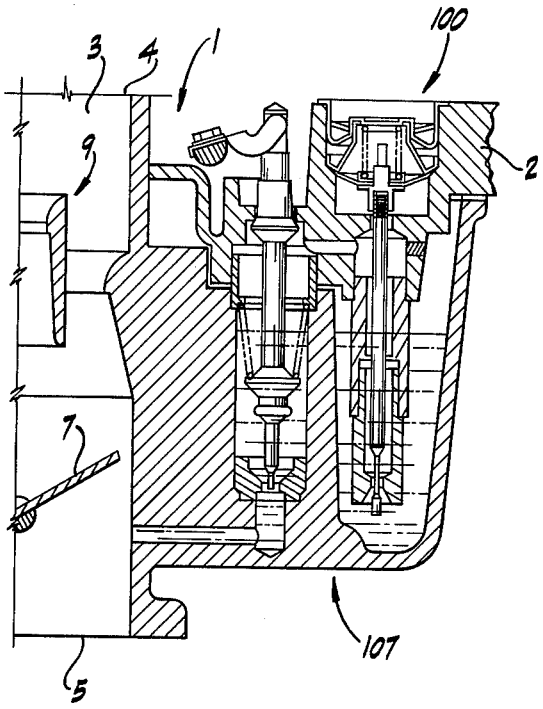
FIG. 3 is a sectional view, partly broken away, of the auxiliary fuel system shown in FIG. 2, in the cold start, cranking position.
Figure 4:
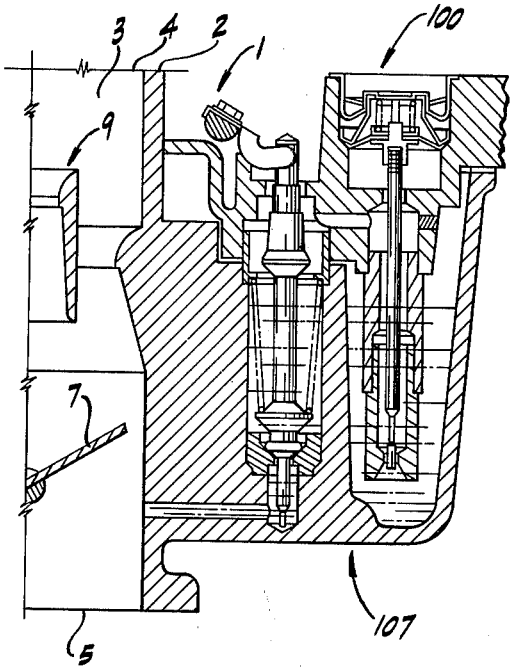
FIG. 4 is a sectional view, partly broken away, of the auxiliary fuel system shown in FIG. 2, in the warm running condition of the engine.

Referring now to FIGS. 2, 3 and 4, the housing 2 includes an auxiliary fuel system casing 35. Casing 35 is interconnected to the fuel bowl 11 by any convenient method. For example, the casing 35 and the fuel bowl 11 may be integrally formed with one another in the construction of the housing 2. Other interconnection techniques are compatible with the broader aspects of our invention. The casing 35 is cup-shaped in section, having a closed bottom end 36 and an opened upper end 37. A portion of a carburetor air horn 38 defines a cover structure which is intermountable with and closes the end 37 of the casing 35. The air horn 38 and the casing 35 define a chamber 39 in their intermounted position. The chamber 39 is divided into a portion **39*a* and a portion 39*b* by a wall 40, integrally formed in the casing 35. The air horn 38 is joined to the casing 35 along a plurality of seals indicated generally by the numeral 42, by any convenient means. Conventional threaded fasteners, not shown, work well, for example. It may be noted that in their intermounted position, the air horn 38 and the casing 35 completely separate the chamber portions 39*a* and 39*b* except along a passage 41 formed in the air horn 38. The passage 41 communicates with the chamber portion 39*a* through a tubular structure 61,** later described in detail.

Air horn 38 has a cavity 43 formed in it. The cavity 43 receives a diaphragm metering rod assembly 48 and provides means for attaching a diaphragm 46 to the air horn 38. The diaphragm rod assembly 48 operates in a conventional manner and includes the flexible diaphragm 46 and a metering rod 57. A side wall part 44 of the cavity 43 defines an annular seat 45 for the diaphragm 46. The diaphragm 46 is conventional and may comprise any of a variety of materials, well known in the art. A cap 47 closes the cavity 43 and with the cavity 43 delimits a chamber 49. Cap 47 is a two part device and includes a part 108 for securing the remaining valve 48 components within the cavity 43 and a part 109 for maintaining the diaphragm 46 position against the seat 45. The chamber 49 is divided by the diaphragm 46 into a chamber part 49*a* and a chamber part 49*b*. The chamber part 49*a* is operatively connected to a source of manifold pressure by a connecting passage 97, while the chamber part 49*b* is at atmospheric pressure.

Part 108 of the cap 47 has an annular recess 51 formed in it which serves as a seat for one end of a spring 52. A connector 53 is mounted for movement with and to the diaphragm 46. The connector 53 includes a central hub part 50. A male end 54 and a female end 55 extend axially outwardly, and a flange 56 extend radially outwardly from the hub 50. The flange 56 defines a seat for a second end of the spring 52 on the chamber portion 49*a* side of the diaghragm 46. The male end 54 of connector 53 functions as a positive stop limiting one direction of travel for the diaphragm 46 as it will abut the recess 51 formed in the cap 47 after a predetermined distance of travel in the upward direction of diaphragm 46 travel, as referenced to in FIGS. 2–4. The female end 55 receives the metering rod 57 along an end 58 of the rod 57. The end 55 of connector 53 and the end 58 of rod 57 may have complimentary threads formed in them as an aid in intermounting the parts, if desired. The metering rod 57 has a plurality of diameters formed in it along the end opposite the end 58 of the rod 57, including a relatively narrow diameter part 59 and a relatively large diameter part 60.

A tubular structure 61 either is formed integrally with or is constructed separately and attached to the air horn 38 during the construction of carburetor structure 1. The tubular structure 61 includes an inner wall defining a channel 110 which communicates with the passage 41 at a first end and with the chamber part 39*a* on a second end of the channel. Structure 61 also includes a restriction 62 formed near its lower end, as referenced to FIGS. 2–4. The rod 57 is mounted for movement in the channel 110 and is free to move therein in response to pressure differences acting on the diaphragm 46. A bottom wall 111 of cavity 43 has an opening through it which receives the rod 57 and defines a guide 63 for supporting the rod during rod 57 movement. As observable in FIGS. 2, 3 and 4, the rod 57 has its lower end positioned with respect to the restriction 62 so that one of the diameter parts 59 and 60 are positioned within the restriction 62. Diameter parts 59 and 60 position, of course, is dependent on diaphragm 46 movement.

Air horn 38 has an opening 64 through it, which communicates with the chamber portion 39*b*. A valve stem 65 is mounted through the opening 64 and is movable within the chamber portion 39*b*. The valve stem 65 has a first end 66 and a second end 67. The end 66 has the link arm 107 attached to it which operatively connects the end 66 to the rod 34.

Mounted near the end 66 side of the stem 65 is an air bypass valve 70. The bypass valve 70 is movable between a closed position wherein the valve 70 abuts a seat 71 defined by that portion of an inner wall of the air horn 38 surrounding the opening 64, and a second position remote from the seat 71. The valve 70 includes an annular stop member 72 and a tapered side wall air metering portion 73. Stop member 72 abuts the seat 71 in the closed position of the valve 70. The tapered portion 73 permits increasingly larger quantities of air to enter the chamber portion 39*b* through the opening 64 as the bypass valve 70 moves in a direction away from the seat 71.

A fitting 69 is mounted along the upper portion of the chamber portion 39*b*. The fitting 69 has a flange 74 extending radially inwardly from it, which defines a seat for one end of a spring 75. The second end of spring 75 is seated against a stop valve 76.

Stop valve assembly 76 is attached to the valve stem 65 near the end 67 of the stem 65. Valve 76 includes a broad diameter upper part 77 and a narrow diameter part 78. The lower part 78 includes an annular closure member 79 having a tapered side wall 80 extending downwardly from it.

The end 67 of the valve stem 65 is a dual diameter device that includes a first part 84 and a second part 85. In the embodiment illustrated, the part 85 has a smaller diameter than the part 84. The dual diameter construction of the end 67 provides a second metering function during the operation of the auxiliary fuel supply system 100, as later explained.

The lower end of the channel portion 39*b* has a receptacle 81 formed in it, the outline of which mates with the annular closure member 79 of the stop valve 76. Again, receptacle 81 may be integrally formed in that portion of the casing 35 defining chamber portion 39*b*, or an insert 68 having the receptacle 81 formed in it, may be constructed separately and placed within the chamber portion 39*b*. The insert 68 has an opening 82 along the apex of the inverted, conical shaped receptacle 81. Opening 82 defines a restriction which receives the end 67 of the valve stem 65. Receptacle 81 receives the lower part 78, retaining the annular closure member 79 of the stop valve 76, and blocks fluid flow through the opening 82 in one position of the valve 76. In all other positions of the stop valve 76, either the part 84 or the part 85 of the end 67 of the stem 65 is positioned within the opening 82.

A passageway 83, formed in casing 35, extends between the opening 82 and the main air bore passageway 3 of the carburetor structure 3, opening into the passageway 3 at a port 112. Port 112 may be positioned below or in ported relationship to the throttle valve 7 in the closed position of that valve. Port 112 is fully below throttle valve 7 when the valve is positioned on the top step 29 of the fast idle cam 23. Position of port 112 is important because engine manifold vacuum will act directly on the port to draw fuel from the auxiliary fuel supply system during engine cranking. In the warm-up operating modes, as the throttle 7 is positioned by succeeding lower cam steps, port 112 may remain below the throttle valve 7, or become in ported relationship to the valve to provide an additional means of varying delivery to the auxiliary system to meet engine requirements.

A vacuum line 86 is operatively connected from the air passageway 3, below the throttle valve 7, to a diaphragm valve 87. As is later explained, the valve 87 functions in a manner analogous to a conventional choke break in conjunction with the auxiliary fuel system 100 to admit air to the auxiliary fuel system after start. The valve 87 includes an enclosure 88 defining a chamber 89 which is divided into a first section 89*a* and a second section 89*b* by a diaphragm 90. Enclosure 88 may be a sheet metal design or an integral part of the carburetor having a first part 113 and a second part 114. The part 114 has a connection nipple 115 integrally formed with it for attaching the line 86 to the section 89*a* portion of the chamber 89. A cup-shaped flange 116 extends about the perimeter of the part 114.

Part 115 includes a central hub 117 having a rod 91 extending through it and an annular peripheral lip 118 which is inserted in the flange 116 to form the enclosure 88. The radially outward edge of the diaphragm 90 is clasped between the annular lip 118 and the flange 116 in the interconnected position of the parts 113 and 114. As indicated, the section 89*a* side of the chamber 89 is connected to manifold pressure through the vacuum line 86, and the section 89*b* side of the chamber 89 is connected to atmospheric pressure through an opening in the enclosure 88, not shown. The rod 91 is mounted to the diaphragm 90 along a first end of the rod, and is movable with the diaphragm 90 in response to pressure differentials in the sections 89*a* and 89*b* of the chamber 89. A second end of the rod 91 is mechanically coupled to the plate 27. Plate 27 has an oblong opening 92 through it which receives a pin 93 in a slip fit. Pin 93 is inserted through the second end of the rod 91 and to opening 92 in plate 27 in attaching one part to the other. Pin 93 is movable in the opening 92 and will permit the rod 91 to rotate the plate 27 whenever it engages the opposite ends of the opening 92. The size and shape of the opening 92 allows some lost motion movement of the rod 91 before the pin 93 engages the plate 27.

As indicated above, the rod 34 also is connected to the plate 27. The thermostatic coil 33 has a first free end 95 and a second end 96 attached to the rod 34. It may be observed, by referring to FIG. 2, that expansion of the coil 33 will cause the rod 34 to rotate in a clockwise direction, while contraction of the coil will cause the rod 34 to rotate in a counter clockwise direction. The actual location of the coil 33, rod 34, plate 27 and valve 87 with respect to the carburetor structure 1 is diagrammatically represented in FIG. 2 and those skilled in the art will recognize that the various components comprising carburetor structure 1 may be attached to the carburetor housing 2 at any convenient location, and interconnected as shown and described.

As previously described, the connecting passageway 97 extends between the main air passageway 3 of the carburetor structure 1 to the diaphragm actuated valve 48, and more particularly, to the chamber part 49*a* side of the chamber 49.

Operation of the auxiliary fuel supply system 100 of this invention may be best understood by referring to FIGS. 2, 3 and 4. As indicated, a cold condition of any engine operatively associated with the carburetor structure 1 may be sensed by the coil 33. When a low temperature is sensed, the coil 33 contracts, rotating the rod 34 counter clockwise. Counter clockwise rotation of the rod 34 moves the valve stem 65 upwardly, as referenced in the drawings, so that annular stop member 72 seats against the seat 71. Counter clockwise rotation of the rod 34 also is transmitted, through the plate 27 and the connecting rod 26 to the fast idle cam 23. Depression of the throttle valve 7 control pedal, not shown, by a vehicle operator, for example, disengages the set screw 31 from whichever of the steps 28 it may abut, and permits fast idle cam 23 to be rotated into a position where the starting step 29 will abut the set screw 31 when the throttle control is released.

The cold start, cranking position of the carburetor structure 1 is illustrated in FIG. 3. As shown, the air bypass valve 70 is in its closed position, and the stop valve 76 is in its open position. During crank and start, the second small diameter part 85 of the end 67 of the valve stem 65 is positioned in the restriction defined by the opening 82. In this position, maximum fuel may flow from the chamber part 39*b* via the opening 82. It also may be observed that because manifold pressure approximates atmospheric pressure, the spring 52 of the valve 48 may deflect the diaphragm 46 downwardly, moving the portion 59 of the metering rod 57 into the restriction 62. Consequently, maximum fuel may flow along the path defined by the chamber part 39*a*, tubular structure 61, passage 41, chamber 39*b*, and passageway 83 to the port 112. As the engine is cranked in starting, manifold pressure decreases, drawing air through the main air passageway 3, past the throttle valve 70. The pressure drop through the venturi restriction 9 draws fuel from the main fuel passage 12. The decreased engine manifold pressure present at the port 112 also draws fuel from the auxiliary fuel supply system 100, which mixes with the fuel-air mixture moving past the throttle valve 7. Fuel from the system 100 enriches the fuel-air mixture and this highly enriched mixture enables the engine to start.

Once the engine starts, the fuel mixture must be leaned in order to enable the engine to function properly. The auxiliary fuel system 100 of this invention provides a lean mixture immediately upon start. Once the engine starts, manifold pressure decreases rapidly, i.e., increases vacuum. The vacuum available after engine start is applied at two places in the system 100 to obtain a leaner fuel-air mixture. First, manifold pressure is applied to the chamber part 49*a* of the valve 48 which enables the atmospheric pressure present in the chamber part 49*b* to drive the diaphragm 46 upwardly, which condition is illustrated in FIG. 2. As the diaphragm 46 moves upwardly, it draws the large diameter part 60 of the metering rod 57 into the restriction 62, thereby lowering the amount of fuel that may be drawn from the chamber part 39*a*. In addition, the presence of manifold vacuum in the main air pasageway 3 below the throttle valve 7 is sensed and transmitted to the diaphragm valve 87 by the vacuum line 86. The decreased pressure in the chamber part 89*a* enables the atmospheric pressure present in the chamber part 89 *b* to deflect the diaphragm 90 towards the right, referenced to FIG. 2. Diaphragm 90 movement draws the rod 91 rightwardly. The rod 91 engages the plate 27 and through that plate, the rod 34, causing the rod 34 to rotate in a clockwise direction, again referenced to FIG. 2. Rotation of the rod 34 forces the link arm 107 and through it, both the valve stem 65 and the air bypass valve 70 move downwardly, so that the bypass valve 70 moves away from the seat 71. Movement of the valve 70 from the seat 71 permits air to enter the chamber 39*b* through the opening 64. As indicated above, the entrance of air through the opening 64 is analogous to the operation of the more conventional choke known in the prior art. Movement of the valve stem 65 as described, places the part 84 of the end 67 within the opening 82. This further reduces the fuel exiting the system 100. Part 84 is a tapered metering surface that modulates delivery during warm-up. Consequently, the system 100 provides a considerably leaner air-fuel mixture immediately after engine start up that becomes progressively leaner as the engine approaches normal operating temperature.

As indicated above, the thermostatic coil 33 is positioned at a point where engine operating temperatures may be sensed conveniently. Conventionally, this point is either at the cooling water jacket for the engine or at the engine exhaust manifold. Howver, those skilled in the art will recognize that other means for operating the coil 33 may be provided, if desired. For example, an electrical heating element may be used to time engine warm up time and expand the coil 33. In any event, as the coil 33 is heated, it expands and continues to rotate the rod 34 in a clockwise direction, which moves the valve stem 65 downwardly. Downward movement of the stem 65 progressively increases the amount of air entering along the opening 64, because the tapered construction of the air metering portion 73 of the air bypass valve 70 effectively increases the opening 64 size. As the engine reaches normal operating temperature, the stop valve 76 enters the receptacle 81 and sets itself against the opening 82, thereby blocking further liquid or air flow through the passage 83. The spring 75 acts as a positive locking device, insuring that the valve 76 remains seated in the receptacle 81.

Becuase the auxiliary fuel system normally will tend to reduce the richness of the fuel-air mixture during the warm-up period, some means for overcoming this tendency must be provided if the carburetor structure 1 is to function properly during high load demands during the warm-up period, as for example, when fast acceleration is called for by the vehicle operator. In the carburetor structure 1, fuel for fast acceleration is provided by the operation of the connecting passage 97 extending between chamber portion 49*a* of the valve 48 and the main air passageway 3. When the vehicle operator calls for increased acceleration, the throttle valve 7 will move to the position shown in phantom lines in FIG. 2. Engine manifold pressure increases, i.e., vacuum decreases, and this pressure increase is sensed and transmitted to the chamber part 49*a* of the valve 48. The increased pressure, together with the force provided by the spring 52 overcomes the atmospheric pressure present in chamber part 49*b* and enables the spring 52 to move the diaphragm 46 downwardly. Since the metering rod 57 moves with the diaphragm 46, downward movement positions the small diameter part 59 in the restriction 62, permitting a greater quantity of fuel to pass through the auxiliary fuel supply system 100.

Continued expansion of the coil 33 rotates both the rod 34 and the plate 27 in a clockwise direction. As plate 27 rotates, it draws the connecting rod 26 upwardly so as to rotate the fast idle cam 23 in a clockwise direction, reference to FIG. 5. This movement is such that the set screw 31 will clear bottom step 30 of cam 23 and come to rest at the normal idle stop (not shown) when the stop valve member 76 is seated in the receptacle 81. Thereafter, the auxiliary fuel supply system 100 does not supply fuel to the main air bore passageway of the carburetor structure 1. The portion of the various components of the auxiliary fuel supply system 100 during warm, normal operating periods is illustrated in FIG. 4. Both the action of the coil 33 acting on the rod 34 and the bias force provided by the spring 75 keep the stop valve 76 seated in the receptacle 81. High engine manifold vacuum present in chamber part 49*a* during warm running periods will tend to draw the diaphragm 46 upwardly, but further metering rod 57 movement is prevented by the abutment of the end 54 of the rod 57 with the cap 47 abutment.

Numerous variations, within the scope of the appended claims, will occur to those skilled in the art in light of the foregoing description and accompanying drawings. Thus, the auxiliary fuel supply system 100 may be used in conjunction with a variety of carburetor models. It is conventional in many carburetor models to stack the venturi restrictions 9 and provide fuel passages in conbination with the stacked venturi passages. The positioning of various components of the auxiliary fuel system 100 may be varied. As indicated, location of the coil 33 and the various interconnecting parts of the system 100 may be changed in other embodiments of this invention. In like manner, other embodiments of this invention may utilize an unloader circuit in connection with the auxiliary fuel supply system 100 in order to remove excess fuel from the engine manifold in the event of engine stall during the warm-up period. These variations are merely illustrative.

Having thus described the invention, what is claimed and desired to be secured by Letters Patent is:

1. In an internal combustion engine including a carburetor having a pivotal throttle plate mounted in an air inlet passageway of said carburetor, a source of fuel and a source of air, the improvement comprising auxiliary fuel supply system means for continuously regulating the fuel-air ratio of said engine from a first, cold starting condition to a second, normal run condition, said auxiliary fuel supply system means comprising a fuel passageway in said carburetor having an outlet positioned below or during certain running conditions in ported relationship to said throttle plate, said fuel passageway extending from said outlet to said source of fuel, shut-off means movably mounted to said carburetor for blocking said fuel passage, air insertion means operatively connected to said shut-off means for admitting air to said fuel passageway, first means for operating said air insertion means upon engine start, second means for operating said shut-off means so as to progressively reduce the output of an air-fuel mixture through said carburetor as the engine warms, moveable fuel metering means operatively connected in said fuel passageway upstream of said air insertion means and said shut-off means, and means for operating said moveable fuel metering means operatively connected to a source of engine manifold pressure.

2. The improvement of claim 1 wherein said first means for operating said air insertion means comprises a first vacuum actuated device operatively connected to a source of engine manifold pressure, said vacuum actuated device adapted to open said air insertion means upon engine start, thereby permitting air to enter said fuel passage.

3. The improvement of claim 2 wherein said auxiliary fuel supply system means includes an air horn structure having a first opening in it, one side of said opening defining a seat for said air insertion means, said air insertion means including a stop portion and a tapered portion extending through said opening and arranged so that the effective size of said opening increases as said stop member moves from said seat.

4. The improvement of claim 3 further characterized by a valve stem movably mounted in the fuel passageway of said auxiliary fuel system means, said valve stem having both said air insertion means, and said shut-off means operatively arranged on it.

5. The improvement of claim 4 wherein said moveable fuel metering operating means comprises a second vacuum actuated device operatively connected to said metering means, said auxiliary fuel system being further characterized by means for sensing pressure below said throttle valve, said sensing means being operatively connected between said air inlet passageway of said carburetor and said second diaphragm actuated device.

* * * * *